US005673968A

United States Patent [19]

Ponzio

[11] Patent Number: 5,673,968

[45] Date of Patent: Oct. 7, 1997

[54] SEAT ASSEMBLY FOR A GAMING TABLE

[76] Inventor: Joseph M. Ponzio, 208 E. Rosedale Ave., Northfield, N.J. 08225

[21] Appl. No.: 701,787

[22] Filed: Aug. 26, 1996

[51] Int. Cl.[6] ..... A47B 39/00

[52] U.S. Cl. ..... 297/143; 297/337

[58] Field of Search ..... 297/143, 140, 297/156, 174, 170, 338, 451.4, 452.55, 344.18, 440.24, 337; 108/50

[56] References Cited

U.S. PATENT DOCUMENTS

| | | | |
|---|---|---|---|
| 784,604 | 3/1905 | Wall | 297/143 |
| 811,259 | 1/1906 | Taylor | 297/452.55 |
| 1,448,253 | 3/1923 | Bodker . | |
| 1,973,866 | 9/1934 | Christianson et al. | 155/123 |
| 2,117,686 | 5/1938 | Sponsler | 155/78 |
| 2,546,871 | 3/1951 | Schley | 297/423.38 |
| 2,935,120 | 5/1960 | Naus | 297/344.18 |
| 3,195,949 | 7/1965 | Mix | 297/140 |
| 3,366,415 | 1/1968 | Cooper | 297/157 |
| 4,406,495 | 9/1983 | Turner | 297/135 |

*Primary Examiner*—Milton Nelson, Jr.
*Attorney, Agent, or Firm*—Norman E. Lehrer

[57] ABSTRACT

A seat assembly for a gaming table includes a seat portion. Extending downwardly from the bottom of the seat portion is a vertically adjustable leg member. An elongated member extends laterally from the seat portion. The elongated member is slidably receivable in a bracket which is adapted to be secured to the undersurface of the gaming table whereby the seat can be moved outwardly so as to be used or inwardly to be stored under the table.

4 Claims, 2 Drawing Sheets

SEAT ASSEMBLY FOR A GAMING TABLE

BACKGROUND OF THE INVENTION

The present invention is directed toward a seat assembly for a gaming table and, more particularly, to such a seat assembly which includes a seat portion which can be slid both under and away from a gaming table attached thereto.

Casino games such as craps and roulette utilize a gaming table on which the game is played and/or bets are placed. Chairs for such gaming tables are not allowed unless certain spatial requirements are satisfied. The spatial requirements are imposed to prevent a potential fire hazard which could be created by chairs interfering with people's ability to quickly exit the casino in the event of a fire. For example, the chairs are often pulled a considerable distance away from the gaming table and left there after the gambler leaves the table.

Most casino operators choose not to provide craps and roulette gaming tables with chairs because of the amount of floor space they would cause to be taken up. The absence of chairs causes gamblers to become fatigued after standing for long periods of time. This results in people leaving the tables earlier than they would have liked. Further, some elderly gamblers or other persons who have difficulty standing do not play casino games which require them to stand.

Accordingly, it is an object of the invention to provide gaming tables with seating means which can be readily moved out of the way when not in use so as not to pose a fire hazard. It is also an object to provide such seating means which cannot be moved more than a predetermined distance away from the gaming table.

SUMMARY OF THE INVENTION

In accordance with the illustrative embodiments, demonstrating features and advantages of the present invention, there is provided a seat assembly for a gaming table which seat assembly includes a seat portion. Extending downwardly from the bottom of the seat portion is a vertically adjustable leg member. An elongated member extends laterally from the seat portion. The elongated member is slidably receivable in a bracket which is adapted to be secured to the undersurface of the gaming table whereby the seat can be pulled out for use or slid under the table and out of the way.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
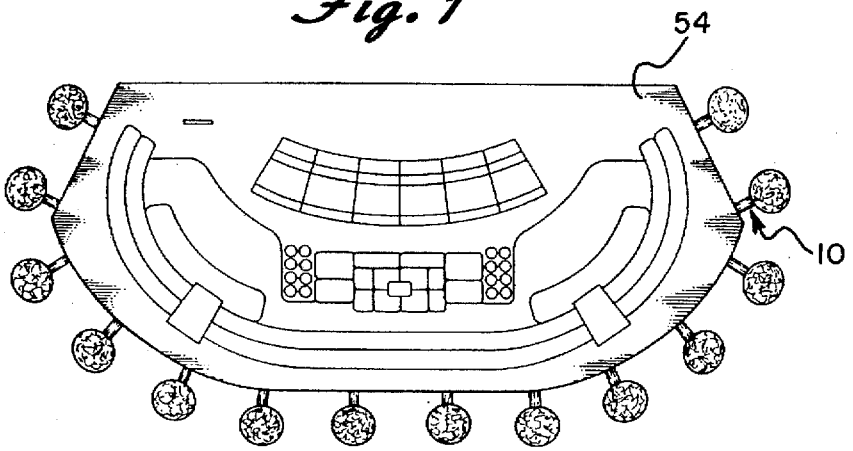
FIG. 1 is a schematic view of a plurality of seat assemblies shown secured around a gaming table.

Referring now to the drawings in detail wherein like reference numerals have been used throughout the various figures to designate like elements, there is shown in FIGS. 2–6 a seat assembly for a gaming table constructed in accordance with the principles of the present invention and designated generally as 10. While only one seat assembly will be described in detail, it should be understood that a plurality of seat assemblies are preferably secured to a gaming table as shown schematically in FIG. 1.

Figure 3:
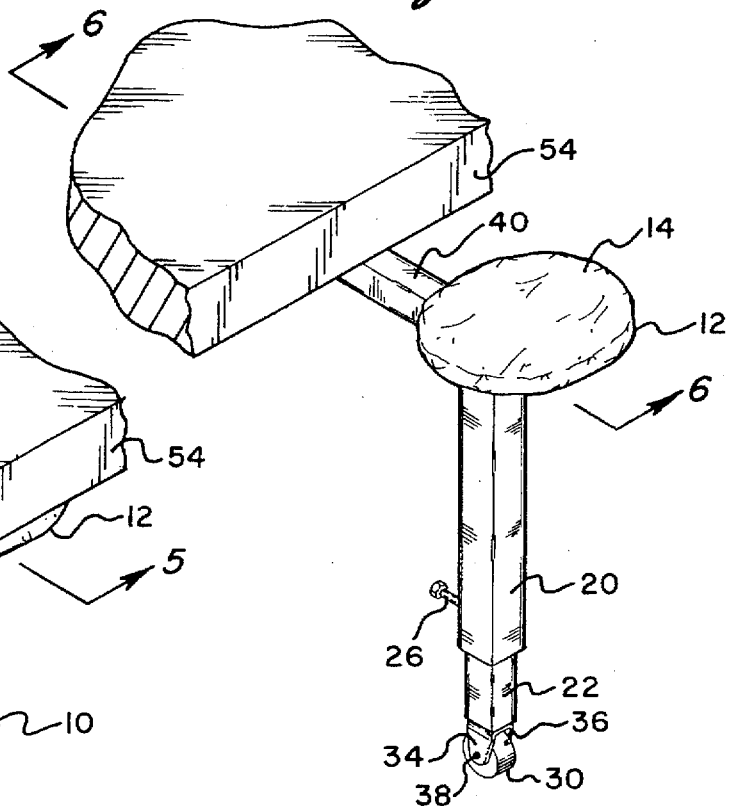
FIG. 3 is a view similar to FIG. 2 showing the seat portion of the assembly positioned away from the table.
Figure 5:
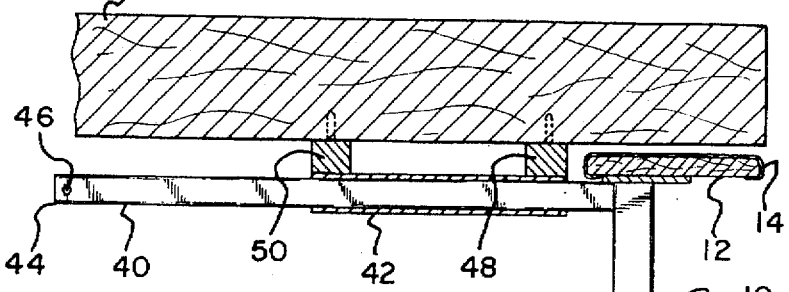
FIG. 5 is a cross-sectional view taken along lines 5—5 of FIG. 2.
Figure 6:
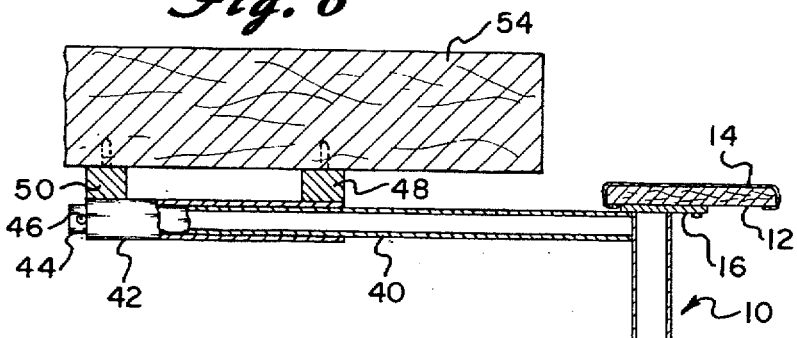
FIG. 6 is a cross-sectional view taken along lines 6—6 of FIG. 3.
Figure 4:
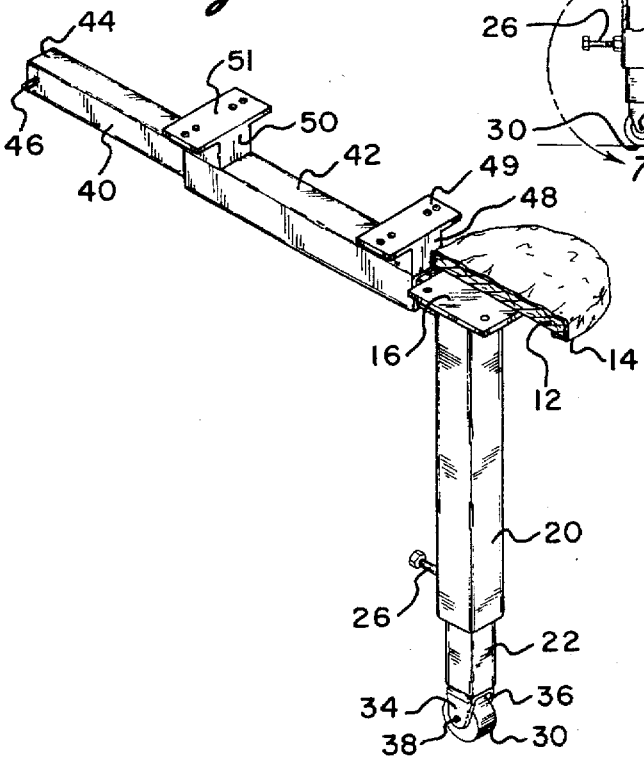
FIG. 4 is a perspective view of the seat assembly showing the seat portion of the same in cross-section.
Figure 7:
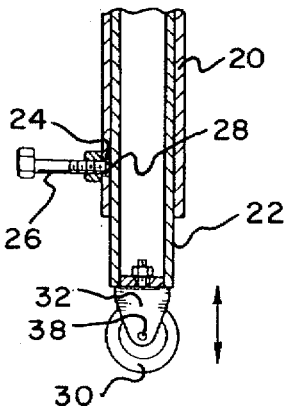
FIG. 7 is a cross-sectional view of the leg member taken along line 7 of FIG. 6.

Referring to FIGS. 2–6, the seat assembly 10 includes a seat portion 12. The seat portion is preferably covered with a layer of cushioning 14. A support plate 16 is screwed to the bottom of the seat portion as illustrated in FIGS. 4, 5 and 6. Extending downwardly from the support plate 16 is a leg member. The leg member preferably includes a first tubular member 20 and a second tubular member 22. The upper end of the first tubular member 20 is preferably secured to the support plate 16. The second tubular 22 member partially passes up into the first tubular member 20 through the bottom end thereof in a telescoping manner. An end of the second tubular member 22 extends downwardly from the bottom end of the first tubular member 20. In the preferred embodiment, the tubular members have a rectangular cross section in order to prevent rotation thereof. The first tubular member has a hole 24 formed therethrough adjacent the bottom end thereof (FIG. 7).

A pin or screw 26 is provided and includes an end 28 which is adapted to be threaded through the hole 24 in the first tubular member. The end 28 presses against the second tubular member as it is threaded through the hole 24 in order to maintain the first and second tubular members at substantially any selected height.

Figure 2:
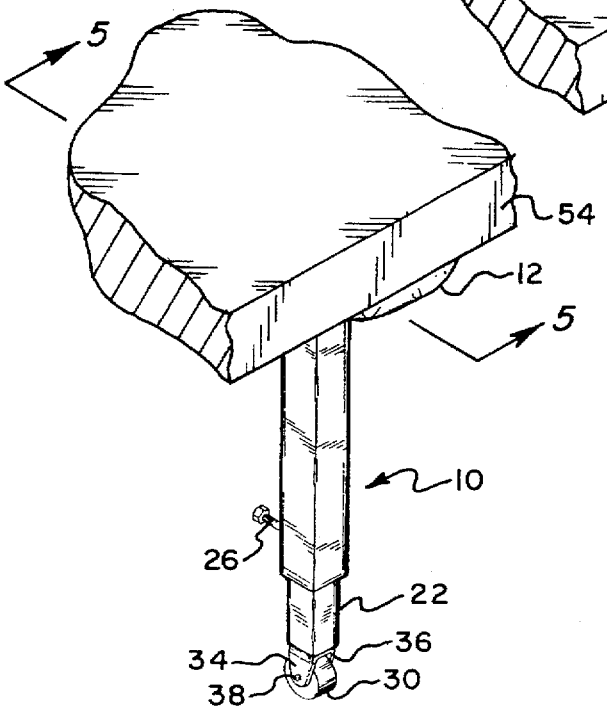
FIG. 2 is a perspective view of a seat assembly for a gaming table according to the present invention and shown in a position under the table.

To allow the leg member to slide freely in and out, a friction reducing means is provided at the bottom thereof. In the preferred embodiment, a roller means in the form of a wheel 30 is secured to the lower end of the second tubular member 22 which extends from the first tubular member 20. More specifically, a wheel bracket 32 is threadably secured to the bottom end of the second tubular member 22 as best illustrated in FIG. 7. The wheel bracket 32 has a pair of opposing sides 34 and 36 (FIGS. 2–4). An axle 38 extends through each of the sides of the bracket and the hub of the wheel 30. The wheel 30 is adapted to movably engage the ground as more fully described below.

The seat assembly 10 includes an elongated member 40 and a tubular bracket 42 associated therewith. The elongated member has one end secured adjacent the bottom of the seat portion 12. The elongated member 40 is slidably receivable in the bracket 42 as shown in FIGS. 4, 5 and 6. The free end 44 of the elongated member 40 extends from the bracket 42. A stop member 46 prevents the free end 44 from being slid out of the bracket 42 (FIGS. 4 and 6).

A pair of mounting members 48 and 50 extend upwardly from the bracket 42 as shown best in FIG. 4. Each of the mounting members includes a substantially planar mounting surface 49 and 51, respectively, spaced from the bracket 42. In use, the mounting surfaces 49 and 51 are placed adjacent the undersurface of a free standing gaming table 54. By free standing it is meant that the gaming table is supported by its own set of legs or the like and does not rely on the seat assembly 10 for support. Screws, nails or the like are passed through holes in the mounting surfaces and into the gaming table in order to secure the seat assembly 10 in place (FIGS. 5 and 6).

The distance between the mounting surfaces 49 and 51 and the bracket 42 is preferably greater than the thickness of the seat portion 12 so that the seat portion can be slid entirely under the gaming table 54. More specifically, the elongated member 40 secures the seat portion 12 to the bracket 42 so that the top of the seat portion is positioned below the bottom of the gaming table 54. Accordingly, the seat portion is free to slide under the gaming table without contacting any part of the same.

In order to facilitate an understanding of the principles associated with the foregoing apparatus, its operation will now be briefly described. Once the seat assembly 10 is secured to the undersurface of the gaming table 54, the height of the lower portion of the leg member relative to the ground and relative to the height of the table is adjusted so that the wheel 30 engages the ground. This is accomplished by sliding the second tubular member 22 downwardly from the first tubular member 20. Once the appropriate height is obtained, the screw 26 is threaded through the hole 24 in the first tubular member until the end 28 of the screw firmly engages the second tubular member thereby preventing further sliding of the same in the first tubular member. Obviously, other means such as a series of spaced openings in the tubular members 20 and 22 and a cooperating pin may be used as the adjusting means in place of the screw 26.

When the seat portion 12 is not being used, it is pushed under the gaming table 54 as shown in FIG. 5. If a gambler wants to sit on the seat, he or she pulls the seat portion away from the gaming table as shown in FIG. 6. The stop member 46 prevents the elongated member from being disengaged from the bracket and the leg 20, 22 supports the weight of the user.

The present invention may be embodied in other specific forms without departing from the spirit or essential attributes thereof and accordingly reference should be made to the appended claims rather than to the foregoing specification as indicating the scope of the invention.

What is claimed is:

1. A seating arrangement for a gaming table comprising:

a free standing gaming table having a periphery and an undersurface;

a plurality of seat assemblies positioned around at least a portion of said periphery of said gaming table;

each of said seat assemblies comprising:

a tubular bracket and a pair of spaced apart mounting members immovably securing said bracket to the undersurface of said table so that said bracket is spaced from the undersurface of said table by a predetermined distance;

a seat portion;

a horizontally disposed elongated member having a first end secured to said seat portion and a second end slidably receivable in said bracket so that said seat portion can be moved under the gaming table or away from said gaming table;

a leg member connected to said seat portion and extending downwardly from the same, friction reducing means secured to the lowermost end of said leg member for movably engaging the ground and means for adjusting the vertical position of said friction reducing means relative to said table.

2. A seating arrangement for a gaming table as claimed in claim 1 wherein each of said leg members is comprised of first and second telescoping tubular members.

3. A seating arrangement for a gaming table as claimed in claim 1 wherein said friction reducing means at the lowermost end of each of said leg members is comprised of roller means.

4. A seating arrangement for a gaming table as claimed in claim 1 wherein said elongated member associated with each of said seat assemblies includes a stop member for preventing said elongated member from being removed from its associated bracket.

* * * * *